United States Patent [19]

Moti

[11] 4,286,170

[45] Aug. 25, 1981

[54] X-RAY FACE MASK AND CHEST SHIELD DEVICE

[76] Inventor: Samuel Moti, 280 Mirabeau Pl., Grosse Pointe Farms, Mich. 48234

[21] Appl. No.: 120,687

[22] Filed: Feb. 11, 1980

[51] Int. Cl.[3] ..... H01J 35/16; G21F 3/02

[52] U.S. Cl. ..... 250/520; 250/516; 250/519; 2/9

[58] Field of Search ..... 250/515, 516–519; 2/8, 9

[56] References Cited

U.S. PATENT DOCUMENTS

| | | | |
|---|---|---|---|
| 1,191,773 | 7/1916 | Dinkuhn | 2/9 |
| 2,223,118 | 11/1940 | Miller | 250/517 |
| 2,406,148 | 8/1946 | Jany | 250/517 |
| 3,045,120 | 7/1962 | Ohrn | 250/517 |
| 3,093,829 | 6/1963 | Maine . | |
| 3,233,248 | 2/1960 | Bushnell | 250/516 |
| 3,302,214 | 2/1967 | Yuritch . | |
| 3,569,713 | 3/1971 | Via | 250/516 |
| 3,707,004 | 12/1962 | Kapitan et al. . | |
| 4,220,867 | 9/1980 | Block | 250/516 |

*Primary Examiner*—Harold A. Dixon

*Attorney, Agent, or Firm*—Harness, Dickey & Pierce

[57] ABSTRACT

In one aspect, a protective face mask designed to shield an x-ray technician or machine operator primarily from random secondary or scatter x-rays deflected toward his face, head and neck by the table, walls, equipment and other reflecting elements in an x-ray room or chamber, during the period of exposure while adjacent the object or person being exposed to the x-ray beam.

In another aspect, the face mask and chest shield device can be mounted on a patient's shoulders in reverse attitude to protect the back of a patient's head and neck from the x-ray beam while being exposed to such beam for chest or upper body portion study and examination.

The face mask is relatively or substantially transparent and contains lead in combination with a plastic ionomer or comonomer, which absorbs or resists penetration, to a degree, of the random deflected secondary or scatter x-rays or the x-ray beam through the mask. The face mask is removably attachable to the chest shield for facile application of the device to and support upon the shoulders of the technician or the patient.

20 Claims, 6 Drawing Figures

X-RAY FACE MASK AND CHEST SHIELD DEVICE

BACKGROUND OF THE INVENTION

It appears that x-ray technicians can become injuriously exposed to an accumulation of random deflected secondary or scatter x-rays over a period of time when they are and work closely or directly adjacent to the body of the object being exposed to the x-ray beam during the x-ray exposure period. Such potential or actual radiation injury is desirably to be avoided. The instant invention was designed to provide protection against such injury.

In taking x-ray images of children and animals, it is difficult to get satisfactory exposures if the child or animal is allowed to remain on the table by itself. It is almost always necessary to hold the child or animal still and substantially motionless during the x-ray exposure period, short as that may be. During this period, the technician wears a rubber or plastic apron and gloves which are filled with or contain a lead shield in one form or another, to absorb or resist the direct and refected x-ray beam and rays. But heretofore, he has had no protection for his upper chest, face, head and neck from random or secondary x-rays deflected by the walls and equipment in the x-ray chamber or room. This invention was designed to provide such protection to the technician who is directly adjacent the body of the object being exposed to the direct x-ray beam.

When a patient is being exposed to an x-ray beam for chest examination, he is usually placed adjacent a wall of the film carrier machine with his chest to the wall, the back of his head and neck facing the projector portion of the x-ray beam equipment. At this time, there is no protection afforded such body portions against direct and indirect exposure of the x-ray beam and deflected rays. This invention provides such protection when the face mask and chest shield device are mounted on the patient in reverse attitude whereby the back of the head, neck and shoulders are shielded from such x-ray beam and secondary rays.

SUMMARY OF THE INVENTION

The face mask and chest shield device of this invention comprises two principal components removably attachable together for mounting upon the shoulders of a person in facing or reverse attitude whereby the person's head, face, neck and shoulders are protected from random deflected x-rays or the direct x-ray beam during the x-ray exposure period.

The face mask is preferably made of and comprises a substantially semi-circular or arcuate relatively transparent plate or sheet of plastic material designed to cover the front and sides of the head and neck in one aspect when used by an x-ray technician, and the back and sides of the head and neck in another aspect when used by a patient being exposed to the x-ray beam for chest or upper body study. The thickness of the face mask can be varied, as can the density or proportion of the lead salt contained in the plastic material. The thickness of the plastic face mask sheet or plate and the proportion of the lead contained therein depends to a very large degree upon the intensity of the x-ray beam directed to the object under examination.

The face mask is preferably made of a plastic material such as, but not limited to, DuPont's "SURLYN" (trademark) material which is a nylon, relatively transparent, lead saltionomer compound containing a weight percent of lead up to about 18% to 20%. Higher proportions of lead salt can also be used. Reference is made particularly to DuPont's U.S. Pat. No. 3,264,272 for the lead-containing plastic material described in Column 5, lines 27–75 and Column 6, lines 1–4, among others as disclosed therein. Lead (Pb), being a Group IV-A metal, comes within the compass of the patent claims 6 and 22.

The chest shield is preferably fabricated of a rubber or plastic sheet material suitably impregnated or filled with a lead material such as lead sheet or film, or with lead particles or salt compound. It need not be transparent. The chest shield is designed for removable attachment to the face mask by suitable fasteners, such as for example snap-type fasteners which are relatively easily engaged and disengaged.

The chest shield is provided with a generally circular chest covering web or body portion and a pair of substantially parallel shoulder straps extending from each end of the body portion. These shoulder straps may be weighted or unweighted depending upon their flexibility and retention characteristics when placed upon the technician's or patient's shoulders.

A principal object of the invention is to provide a radiation protective device for an x-ray technician when in closely adjacent proximity to an object being exposed to an x-ray beam from exposure of his face, head, neck and upper chest to random secondary or scatter x-rays deflected from equipment in or walls of an x-ray chamber or room, during the x-ray exposure period.

Another principal object of the invention is to provide a protective device for a patient being exposed to an x-ray beam for chest or upper torso study or investigation from direct exposure to the back or sides of his head, face, neck and shoulders, during the x-ray exposure period.

Another object of the invention is to provide a relatively stable radiation protective device removably mountable upon the shoulders of the x-ray technician or patient, which comprises a substantially transparent face mask and removably attachable chest shield made of material which substantially absorbs or resists the transmission of random deflected x-rays or x-ray beams, so as to protect such persons from an accumulation, over a period of time, of injurious radiation.

These and other objects and advantages of the invention will become more apparent by reference to the following detailed specification to be read in context with the attendant drawings.

DESCRIPTION OF PREFERRED EMBODIMENTS

Figure 1:
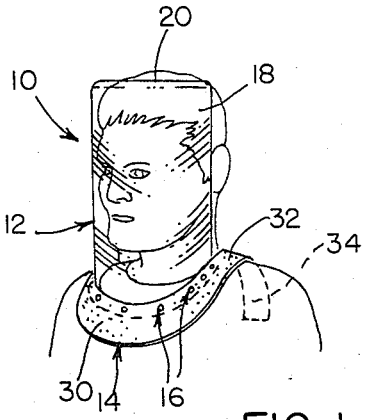
FIG. 1 is a perspective view of the face mask and chest shield device mounted upon the shoulders of a person, such for example as an x-ray technician, to protect him from random deflected secondary x-rays.
Figure 2:
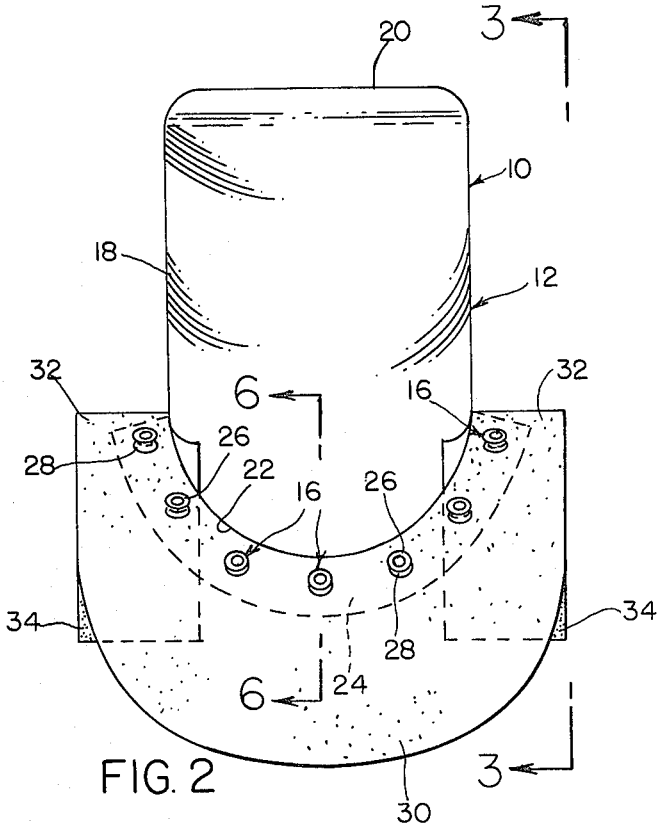
FIG. 2 is a front elevational view taken substantially on the line 2—2 of FIG. 1.
Figure 3:
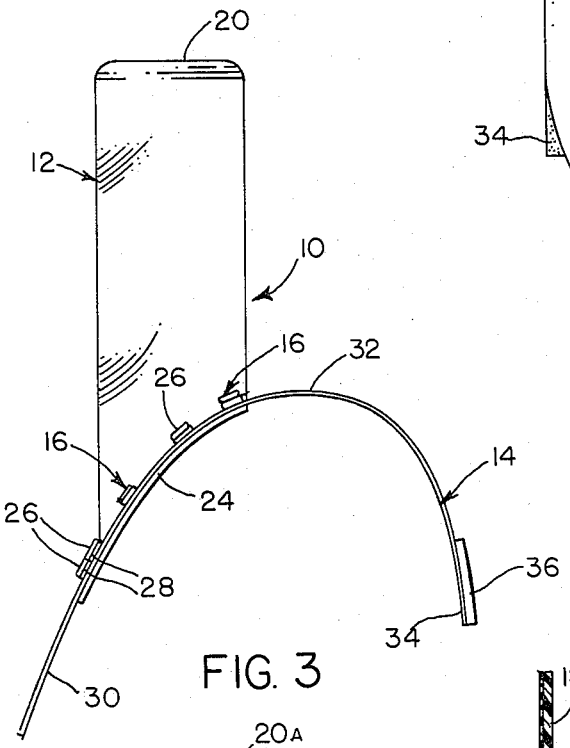
FIG. 3 is a side elevational view taken substantially on the line 3—3 of FIG. 1.

Although the disclosure made herein is substantially detailed to enable those skilled in the art to practice the invention, the physical embodiments herein described are merely exemplifications of structures which are considered fuctionally useful or suitable for embodiment in other specific structures. The scope of the invention is defined in the claims appended hereto.

As shown particularly in the several views of the drawing sheet, in general, the radiation protective device 10 comprises a face mask 12 and a chest shield 14 removably attachable together by suitable fasteners 16, such for example as the two-piece snap-type.

The face mask 12 is made of a substantially transparent lead containing ionomer, such for example DuPont de Nemour's "SURLYN" material containing a lead salt according to U.S. Pat. No. 3,264,272, containing up to about 18% to 20% or more by weight of a lead salt according to the disclosure and claims 6 and/or 22 of said patent. The radiation absorption capabilities of the lead salt containing ionomer are designed to provide the radiation protection that the x-ray technician requires, when handling a small child or animal on the table during its exposure to the direct x-ray beam, against secondary radiation or soft or scatter rays which may be deflected toward his face, head and/or neck.

In all these operations, the technician wears a radiation protective apron which covers his chest, torso and legs. The apron is or may be of the style and construction disclosed in Maine U.S. Pat. No. 3,093,829 for Protective Apron Construction, or of any other suitable style and construction. The face mask and chest shield device 10 of this invention is used in addition to such apron structure.

The face mask 12 comprises a relatively clear transparent body portion 18 of semi-circular, somewhat partially cylindrical, or arcuate form having an upper margin 20 and a lower arcuate margin 22 which terminates in an outwardly projecting lateral flange 24 of circular or arcuate form provided with a plurality of fastener members 26 adapted to be removably secured to complementary fastener members 28 mounted upon or attached to the chest shield 14.

The face mask 18, made of the above-described lead containing SURLYN material, is designed to protect the front and sides of the head and neck, extending rearwardly to a line beyond the temples of the wearer. The body portion may be of any suitable thickness adequate to provide protection against the secondary radiation shielding for which the invention was created.

The chest shield 14 comprises a lead filled or leadcontaining opaque rubber or plastic body or sheet of material having the fastener members 28 affixed thereto in a pattern in register with the fastener members 26 affixed to the face mask flange 24. The medial web or body portion 30 is generally circular or arcuate and terminates at each lateral end in shoulder straps 32,32 which are generally parallel to each other and of a length suitable to rest upon the shoulders and somewhat down upon the back of the wearer. The distal ends, 34,34 of the straps 32,32 may be provided with lead weights 36,36 or other suitable weights to balance the load applied by the face mask 12 and the chest shield 14 directed forwardly.

Figure 5:
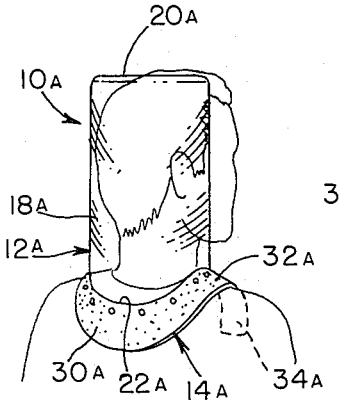
FIG. 5 is a view similar to FIG. 1, showing the face mask and chest shield device mounted reversely upon the shoulders of a patient being subject to a chest or upper torso study or examination, for protection against direct x-ray beam exposure to the back and sides of his head, neck and shoulders.

FIG. 5 is an illustration of the device 10 being used in reverse fashion, as for example by a patient who is being x-rayed for chest study and examination. In such event, the patient wears no apron but only the device 10 which is now positioned upon his shoulders with the shoulder strap ends **34*a*,34*a* directed forwardly and the body portion 30*a* of the bib shield 14*a* resting adjacent or just below the back of his neck. The face mask 12*a*** now shields the back and rear sides of the patient's head and neck to protect him against direct beam, as well as secondary radiation x-rays.

Figure 6:
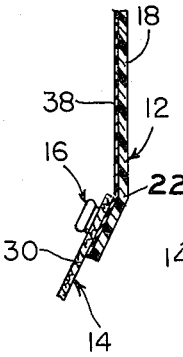
FIG. 6 is a vertical sectional view taken substantially on the line 6—6 of FIG. 2.
Figure 4:
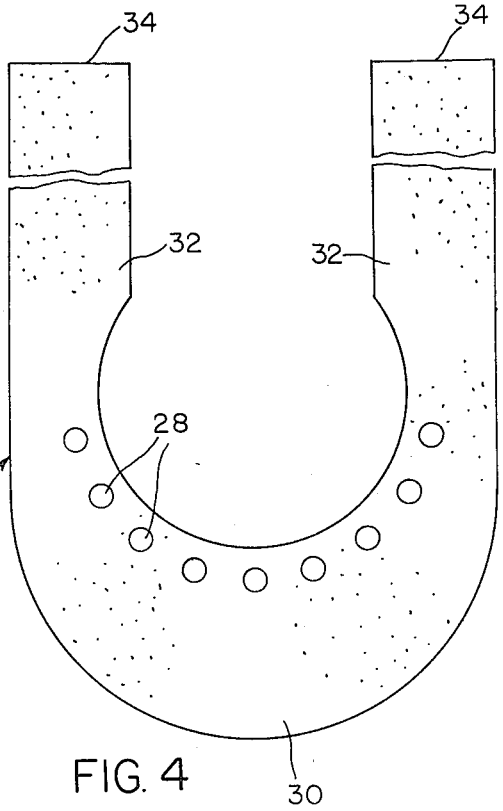
FIG. 4 is a top plan view of the chest shield portion of the device illustrated in FIG. 1.

A modification of the face mask 12 (FIG. 6) involves its lamination with a physically protective outer layer 38 of a clear transparent film such as DuPont's "MYLAR" material which comprises a polyester resin made by the condensation of a terephthalic acid and ethylene glycol.

The tough MYLAR layer is preferably laminated or adhered to the entire facing surface of the face mask SURLYN material by a suitable adhesive or other means to provide a physically protective layer against scratching of the outer surface of the face mask. Such scratching or abrasive effects, applied physically, could well interfere with the clarity or transparency of the face mask. It would be desirable to avoid such deleterious conditions by use of an outer MYLAR layer or by other suitable coating.

Another advantage of the device 10 resides in the fact that the face mask 12 is made of a plastic material which is far less frangible than a lead-containing glass which is much heavier and more fragile than the lead-containing SURLYN plastic. If the plastic face mask is covered by an adhered MYLAR laminate layer, it is further reinforced against breakage.

I claim:

1. An improved device for shielding and protecting a person against secondary or scatter radiation to the face, head and neck, and to be worn on the shoulders of such person, wherein the improvement comprises a face mask of a relatively clear substantially transparent lead containing radiation shielding material and having a facing side and lateral rearwardly extending portions covering the front and at least a portion of the sides of the wearer's face, head and neck, said face mask having upper and lower margins, a chest shield of a lead-containing rubber or plastic sheet radiation shielding material having a medial web portion to lie upon the wearer's chest closely adjacent and below said face mask, and distal shoulder strap portions extending from the ends of said web portion to lie upon the wearer's shoulders, and means securing said chest shield to said face mask to form a unitary radiation shielding device.

2. The device defined in claim 1, wherein said face mask is integrally formed of a radiation shielding, lead-containing ionomer plastic material.

3. The device defined in claim 2, wherein said face mask facing side is generally arcuate in transverse cross-section.

4. The device defined in claim 2, wherein said face mask facing side is generally arcuate in transverse cross-section and said lateral rearwardly extending portions are generally planar.

5. The device defined in claim 2, wherein said plastic material contains up to about 18% to 20% of a lead salt, by weight percent.

6. The device defined in claim 2, wherein said chest shield is opaque.

7. The device defined in claim 2, wherein said face mask terminates at its lower margin in an outwardly projecting lateral flange extending forwardly and laterally and is provided with fastening means affixed to said flange removably attachable to said chest shield.

8. The device defined in claim 7, wherein said chest shield is provided adjacent its arcuate upper margin with fastening means removably attachable to said fastening means affixed to said face mask lateral flange.

9. The device defined in claim 8, wherein said means removably securing said chest shield to said face mask comprises a plurality of separable removably attachable snap-type fasteners affixed to said chest shield and face mask.

10. The device defined in claims 1 or 2, wherein said chest shield shoulder straps are provided adjacent their distal ends with weights affixed thereto, to maintain said device upon the shoulders of the wearer.

11. An improved device for shielding and protecting a person against direct beam x-ray radiation to the back of the head and neck, and to be worn on the shoulders of such person, wherein the improvement comprises a head and neck mask of a relatively clear substantially transparent lead containing radiation shielding material having a facing side and lateral rearwardly extending portions covering the back and at least portions of the sides of the wearer's head and neck, said head and neck mask having upper and lower margins, a bib shield of a lead-containing rubber or plastic sheet radiation shielding material having a medial web portion to lie upon the wearer's upper back adjacent his neck, and distal shoulder strap portions extending from the ends of said web portion to lie upon the wearer's shoulders adjacent the upper portion of his chest, and means securing said bib shield to said head and neck mask to form a unitary radiation shielding device.

12. The device defined in claim 11, wherein said head and neck mask is integrally formed of a radiation shielding, lead-containing ionomer plastic material.

13. The device defined in claim 12, wherein said head and neck mask facing side is generally arcuate in transverse cross-section.

14. The device defined in claim 12, wherein said head and neck mask facing side is generally arcuate in transverse cross-section and said lateral rearwardly extending portions are generally planar.

15. The device defined in claim 12, wherein said plastic material contains up to about 18% to 20% of a lead salt, by weight percent.

16. The device defined in claim 12, wherein said bib shield is opaque.

17. The device defined in claim 12, wherein said head and neck mask terminates at its lower margin in an outwardly projecting lateral flange extending generally rearwardly and laterally and is provided with fastening means affixed to said flange removably attachable to said bib shield.

18. The device defined in claim 17, wherein said bib shield is provided adjacent its arcuate upper margin with fastening means removably attachable to said fastening means affixed to said head and neck mask lateral flange.

19. The device defined in claim 18, wherein said means removably securing said bib shield to said head and neck mask comprises a plurality of separable removably attachable snap-type fasteners affixed to said bib shield and head and neck mask.

20. The device defined in claim 11 or 12, wherein said bib shield shoulder straps are provided adjacent their distal ends with weights affixed thereto, to maintain said device upon the shoulders of the wearer.

* * * * *